US008549768B2

(12) United States Patent
Chakravarty et al.

(10) Patent No.: US 8,549,768 B2
(45) Date of Patent: Oct. 8, 2013

(54) METHODS FOR FREEZE DRYING

(75) Inventors: Prerona Chakravarty, Springfield, NJ (US); Ron C. Lee, Bloomsbury, NJ (US)

(73) Assignee: Linde Aktiengesellschaft, Munich (DE)

( * ) Notice: Subject to any disclaimer, the term of this patent is extended or adjusted under 35 U.S.C. 154(b) by 306 days.

(21) Appl. No.: 13/045,639

(22) Filed: Mar. 11, 2011

(65) Prior Publication Data

US 2012/0227277 A1 Sep. 13, 2012

(51) Int. Cl.
*F26B 5/06* (2006.01)

(52) U.S. Cl.
USPC ..... 34/284; 34/287; 34/428; 62/66; 62/407; 514/184; 549/206; 250/443.1; 424/409; 435/809

(58) Field of Classification Search
USPC ..... 34/284, 287, 298, 402, 428; 62/66, 407; 514/184; 549/206; 250/443.1; 424/406, 424/84, 93.5, 405, 409; 435/303.1, 809
See application file for complete search history.

(56) References Cited

U.S. PATENT DOCUMENTS

| | | | | |
|---|---|---|---|---|
| 4,612,200 | A * | 9/1986 | Sato | 426/242 |
| 5,520,004 | A * | 5/1996 | Jones, III | 62/63 |
| 5,727,333 | A * | 3/1998 | Folan | 34/285 |
| 5,822,882 | A * | 10/1998 | Anger | 34/296 |
| 5,884,413 | A * | 3/1999 | Anger | 34/92 |
| 5,884,414 | A * | 3/1999 | Anger | 34/92 |
| 6,163,979 | A * | 12/2000 | Oetjen et al. | 34/286 |
| 6,311,409 | B1 * | 11/2001 | Coppa et al. | 34/92 |
| 6,684,524 | B1 * | 2/2004 | Sennhenn et al. | 34/287 |
| 8,240,065 | B2 * | 8/2012 | Rampersad et al. | 34/558 |
| 2002/0124431 | A1 * | 9/2002 | Duhaut et al. | 34/417 |
| 2006/0277926 | A1 * | 12/2006 | Brahmbhatt | 62/64 |
| 2006/0277927 | A1 * | 12/2006 | Brahmbhatt | 62/64 |
| 2006/0281171 | A1 * | 12/2006 | Brahmbhatt | 435/303.1 |
| 2007/0186437 | A1 | 8/2007 | Gasteyer | |
| 2007/0186567 | A1 | 8/2007 | Gasteyer et al. | |
| 2009/0104099 | A1 | 4/2009 | Au-Yeung et al. | |
| 2009/0232894 | A1 | 9/2009 | Chouvene et al. | |
| 2010/0242301 | A1 | 9/2010 | Rampersad et al. | |
| 2011/0104216 | A1 * | 5/2011 | Richter-Friis et al. | 424/400 |
| 2011/0179667 | A1 * | 7/2011 | Lee et al. | 34/287 |
| 2011/0283717 | A1 * | 11/2011 | Cheng | 62/62 |
| 2012/0227277 | A1 * | 9/2012 | Chakravarty et al. | 34/284 |

FOREIGN PATENT DOCUMENTS

| | | | | |
|---|---|---|---|---|
| GB | 2119625 | A * | 11/1983 | A23F 5/30 |
| JP | 59169504 | A * | 9/1984 | B01D 9/04 |
| WO | WO 2004073096 | A1 * | 8/2004 | H01M 4/92 |
| WO | WO 2005058474 | A1 * | 6/2005 | B01J 2/02 |
| WO | WO 2011/034980 | A1 | 3/2011 | |

OTHER PUBLICATIONS

Rambhatla, Ramot, Bhugra and Pikal, Heat and Mass Transfer Scale-up Issues During Freeze Drying . . . , AAPS PharmSciTech 2004; 5(4) Article 58.

* cited by examiner

*Primary Examiner* — Steve M Gravini
(74) *Attorney, Agent, or Firm* — Philip H. Von Neida

(57) ABSTRACT

A method for producing a fog of ice nuclei by introducing a cryogenic fluid and a humid gas stream into a freeze dryer. The cryogenic fluid and humid gas stream will form ice nuclei having a preferred size for introduction into vials contained in the freeze dryer.

15 Claims, 4 Drawing Sheets

METHODS FOR FREEZE DRYING

BACKGROUND OF THE INVENTION

A method for generating a stable dispersion of nucleating ice crystals having a size for inducing nucleation during freeze drying. The ice crystals are formed using a cryogenic fluid and a carrier gas saturated with vapor such as water vapor. A sequential injection method is used to facilitate the growth of larger ice crystals for improved nucleating performance during freeze drying.

Intervial variability in freezing can be a significant scale-up problem in pharmaceutical freeze drying because a freezing procedure optimized in the laboratory may not transfer exactly to a manufacturing scale where the air is virtually free of particulate impurities. This variability results because of supercooling of water in very clean environments which can cause the water to remain as a liquid, even at temperatures as low as −40° C. A vial filled with aqueous product being cooled in such a particulate-free atmosphere can therefore freeze anywhere between about 0° C. and −40° C.

A typical pharmaceutical freeze drying system involves the freezing and subsequent freeze drying of hundreds to thousands of small vials containing the typically aqueous based product to be processed. Due to the extremely clean production environments, all or most of the vials could undergo supercooling and each freeze at different temperatures below 0° C. Vials freezing at higher temperatures have preferred ice structure and shorter primary drying time compared to vials freezing at lower temperatures. Optimizing cycle time is therefore very difficult because there is difficulty in controlling or eliminating the uncertainty in vial-to-vial freezing temperatures and the subsequent lack of common drying behavior.

One way to reduce supercooling and/or cause all supercooled vials to freeze at the same time is to induce freezing by introducing ice nuclei into the supercooled solution. The presence of the ice nuclei provides a suitable and benign substrate for the supercooled water to crystallize onto and freeze into ice. If all vials are cooled to the same temperature are subjected to such a freezing substrate at approximately the same time, then all the vials will freeze at that time. This in turn will eliminate the vial-to-vial variability resulting from vials freezing at different degrees of supercooling and leads to improved product and process control.

Stability and size of ice nuclei are considered critical factors in inducing freezing in vials for two reasons. First, the ice nuclei formed must remain in the solid state and not dissipate, sublimate or melt before they can make their way into the vials and into the solution therein. Second, the nuclei must overcome and penetrate the surface region of the solution inside the vial and cause the necessary perturbation to induce freezing of the supercooled solution. Larger ice nucleating particles are preferred so that they actually perturb the solution to cause the structural orientation necessary for crystallization or act as a substrate for the supercooled solution to freeze on, as opposed to remaining suspended above the solution surface.

Generating ice crystals of preferred size requires an understanding of the microphysics involved. In nature, snow crystals form when supercooled water droplets freeze on suspended dust particles which serve as freezing nuclei. Once an ice crystal is formed, its growth or decay will depend on the humidity conditions around it. The driving force for ice crystal growth is supersaturation which is a function of ice temperature.

Since the saturated water vapor pressure of ice is lower than that of supercooled water at the same temperature, the water vapor can become supersaturated with respect to ice, causing the crystals to grow at the expense of other water droplets via vapor deposition (the Bergeron process). Crystals can also grow by collision with supercooled water droplets which subsequently freeze. Depending on the degree of supersaturation and temperature, crystals of different size and geometries can evolve and this has been supported by several studies, such as "The Physics of Snow Crystals", Kenneth G. Libbrecht, 2005 Rep. Prog. Phys. 68; "Microphysics of Clouds and Precipitation", Chapter 2, Volume 17, 2006 Springer. If this driving force is not sufficiently high, the ice crystals can sublimate into vapor or melt into liquid water before reaching a critical size.

SUMMARY OF THE INVENTION

In order to address these shortcomings, the inventors have discovered a method for producing a fog of stable ice nuclei having a preferred size by controlled introduction of a cryogenic fluid and a humid gas stream inside a freeze dryer.

More particularly, the invention provides for a method for producing a fog of ice nuclei in a freeze dryer through the introduction of a cryogenic fluid and a humid gas stream.

Additionally, the invention provides for a method for producing a fog of ice nuclei comprising introducing a cryogenic fluid and a humid gas stream into a freeze dryer.

In the methods of the invention the ice nuclei are stable due to the controlled introduction of the cryogenic fluid and humid gas stream. This results in ice nuclei being of a preferred size for purposes of entering the vials. The freeze dryer where the invention is performed contains vials which contain content that is to be frozen.

The cryogenic fluid is contained within a carrier gas. The cryogenic fluid is selected from the group consisting of nitrogen, oxygen, air and argon. The carrier gas may be the same or different from the cryogenic fluid.

The humid gas stream comprises water vapor in nitrogen. The humid gas stream may also be selected from the group consisting of steam injection into nitrogen, sparging nitrogen into a water bath and spraying or atomizing water into a nitrogen stream.

When the cryogenic fluid and humid gas stream are introduced into the freeze dryer, a mixing zone is created.

In another embodiment of the invention, there is disclosed a method for forming a fog of ice nuclei in a freeze dryer comprising the steps:

a) introducing a humid carrier gas into the freeze dryer, thereby forming a water vapor region;
b) introducing a cryogenic fluid into the freeze dryer, thereby contacting the humid carrier gas and forming an ice fog region surrounded by the water vapor region; the ice fog region will contain ice nuclei.
c) introducing a humid carrier gas into the freeze dryer, thereby forming a second water vapor region and the water vapor region and the ice fog region mix to form a mixed growth region; and
d) introducing a cryogenic fluid into the freeze dryer, thereby contacting the second water vapor region to produce a second ice fog region within the second water vapor region and the mixed growth region.

The freeze dryer where the invention is employed comprises at least one means for inputting material and at least one means for venting material. The freeze dryer will contain cold plates and the vials containing the material to be freeze dried contained therein.

A mixing zone is created at the entrance of the freeze dryer. The ice nuclei that are generated in the ice fog of step a) will grow in size in the mixed growth region of step c). Newly generated ice nuclei will be present in the second ice fog region; these newly generated ice nuclei will be uniformly dispersed in the second ice fog region.

In the instant invention, the ice nucleus is generated directly from vapor such as water vapor without the intermediate liquid state. With no droplets and no condensation nuclei, getting vapor molecules to come to an orderly crystal arrangement will require ultrafast cooling rates and a critical vapor mass necessary to facilitate this molecular arrangement. So the relative humidity of the gas, cooling rates and final temperatures need to be controlled to create conditions for ice nucleation directly from vapor. Once an ice crystal is generated via ultrafast cooling of vapor, the environment surrounding the ice crystal will become extremely dry due to freezing of all available vapors. This could subsequently cause the ice to sublimate or melt to maintain the equilibrium partial pressure as the stream warms in the freeze dryer. To prevent this, water vapor cooled or heated to the preferred temperature has to be constantly replenished such that the driving force for ice crystal survival and growth is maintained. The invention is directed toward addressing this problem with generating stable ice nuclei directly from vapor and particularly to extremely clean and sterile freeze drying processes.

The cryogenic cooling fluid and carrier gas may be a fluid selected from the group consisting of nitrogen, oxygen, air, argon or other fluid that can act as either a cooling fluid or carrier gas. For purposes of the invention, the cooling fluid and carrier gas may be the same or different.

The cooling fluid and carrier gas may be introduced into the freeze drying chamber at a variety of temperatures, pressures and humidity levels. For cooling gas, temperatures are preferably in the range of −20° C. to −180° C. and for carrier gas temperature range is preferably between ambient to −70° C. Preferable range for pressure is from 0.1 bar to 2 bar, and for humidity from 50% to 100%. The cooling fluid, carrier gas, steam and any other fluid introduced into the freeze drying chamber may be suitably processed prior to introduction by means such as filtration to produce sterile fluids. These streams can also be injected into the freeze drying chamber at a variety of injection points.

The humid gas stream, such as water vapor in nitrogen may be formed by a variety of know techniques and at a broad range of temperatures. Various humid gas streams are selected from the group consisting of steam injection into nitrogen, sparging nitrogen into a water bath and spraying or atomizing water into a nitrogen stream.

The nucleating ice crystals may be formed from any suitable condensable vapor, including water or other gases. The condensable vapor may be introduced into the freeze drying chamber by a variety of means including steam.

The pressure of the freezing process and/or nucleating ice step may be varied to achieve the appropriate environment for freeze drying application.

The products that are freeze dried by the methods of the invention may be any type that are typically freeze dried and may be contained in any configuration within the freezing chamber including vials, trays or other types or combinations of containers.

DETAILED DESCRIPTION OF THE INVENTION

Figure 1:
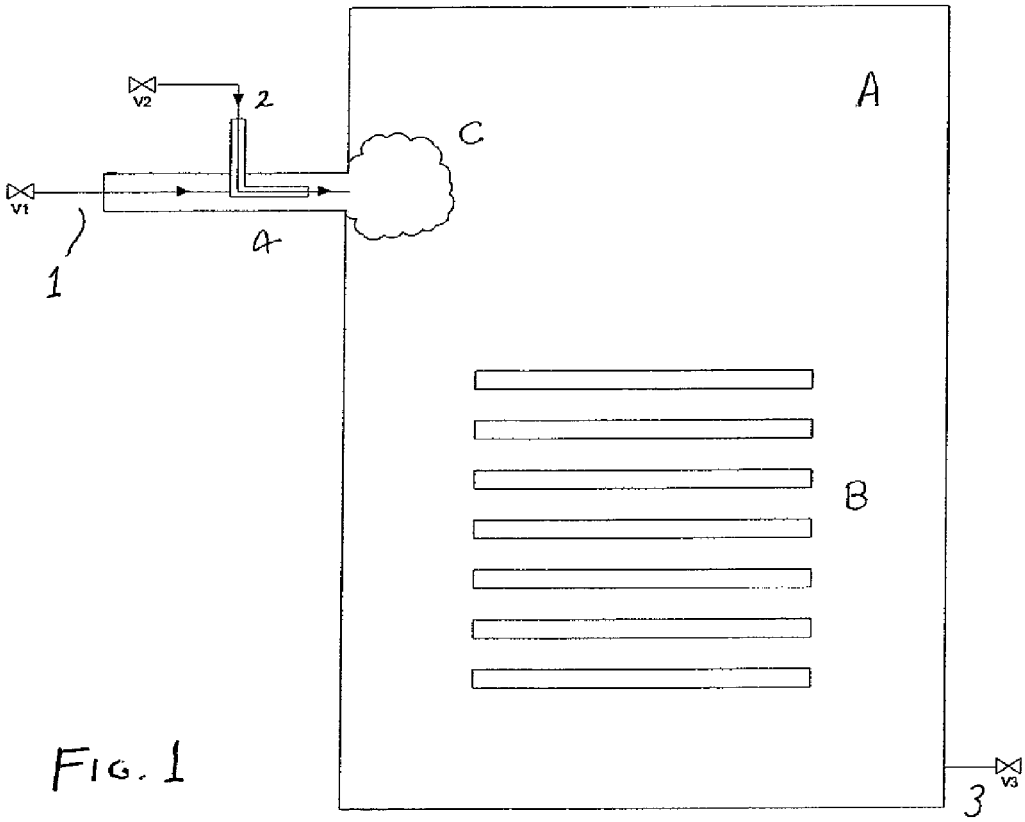
FIG. 1 is a schematic illustration of water vapor being introduced into a freeze dryer.
Figure 2:
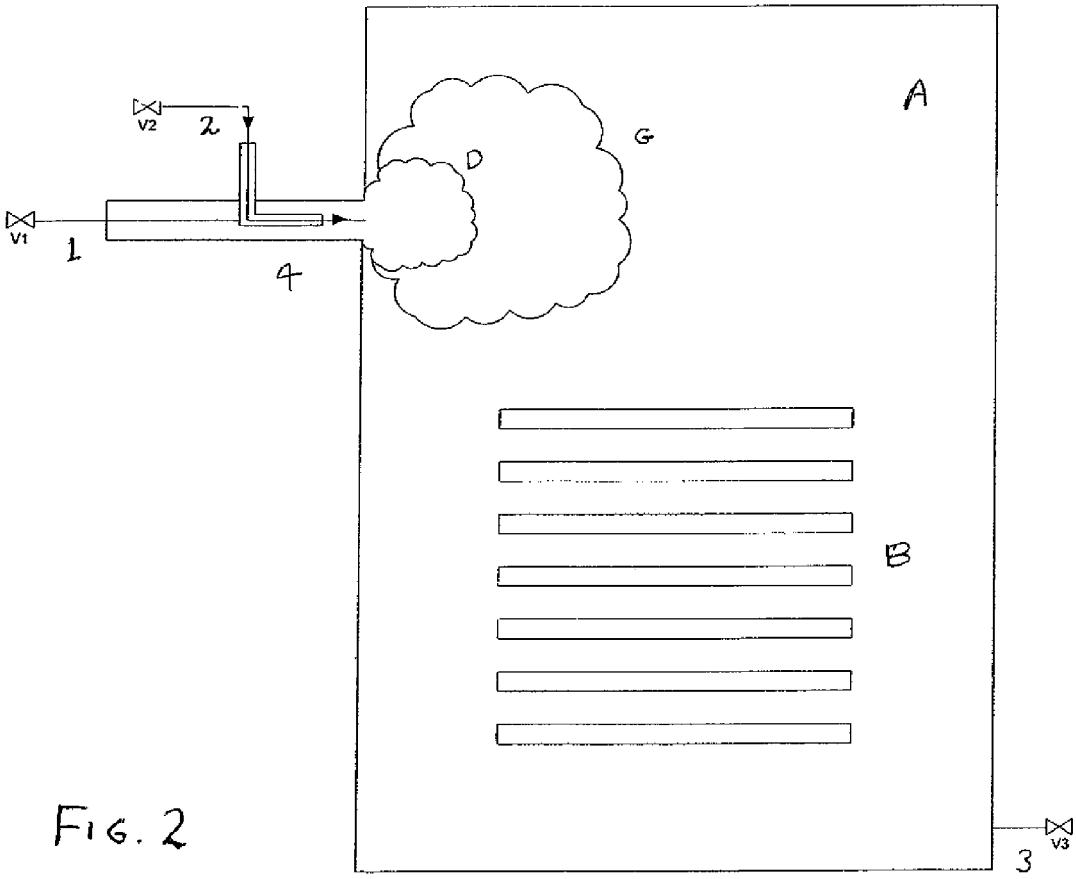
FIG. 2 is a schematic illustration showing both an ice fog region and water vapor region in a freeze dryer.

FIG. 1 illustrates the method of the invention in a freeze dryer. The vials containing the product to be freeze dried are place on cold plates inside the freezing chamber. The initial phase of the freezing process is generally conducted at atmospheric pressure and the vials are generally cooled to a suitable temperature at or below their maximum freezing point temperature which is typically 0° C. There are two inlet valves to the freezing chamber V1 and V2, the valve V1 for injecting the cryogenic cooling fluid such as cold nitrogen gas and the second valve V2 for injecting the water vapor carrier gas such as humid nitrogen gas. Valve V3 is the vent valve for maintaining the preferred atmospheric pressure within the chamber. Other methods can be employed for controlling the flow of cooling gas such as the motive flow provide by an ejector or a blower. In the figures, like equipment is labeled the same throughout the description of the four figures. A mixing zone is created at or prior to the entrance of the freezing chamber to facilitate heat and mass transfer between the two streams. The temperature and humidity of the carrier stream, the temperature of the cooling fluid and the temperature of the freezing chamber is adjusted to desired values by use of appropriate control logic. For cooling gas, temperatures are preferably in the range of −20° C. to −180° C. and for carrier gas temperature range is preferably between ambient to −70° C. Preferable range for pressure is from 0.1 bar to 2 bar, and for humidity the range is 50% to 100%. The generation of the stable ice fog is then accomplished by the following sequence of steps.

In step 1, as shown in FIG. 1, a freezing dryer chamber A contains cold plates B where vials that contain the product to be freeze dried are placed. Valve V2 is opened while valve V1 is closed so that no cryogenic fluid enters tube 4 through line 1 and relatively warm, humid carrier gas is introduced through line 2 and tube 4 for a period of time t1 into the freeze dryer A to form a water vapor region C. Valve V3 can be opened and closed to maintain the appropriate pressure in the freezing dryer chamber A.

In step 2, valve V1 is opened and valve V2 is kept open. The cryogenic fluid is fed through line 1 to tube 4 and comes in contact with the humid gas fed through line 2 into tube 4. The combination enters the freezing dryer chamber A and freezes out the water vapor and generates a uniform dispersion of small ice nuclei. This is allowed to proceed for time t2 and at the end of t2, an ice fog region D containing newly generated ice nuclei has been created. This ice fog region D is surrounded by the water vapor region G which was formed in step 1.

Figure 3:
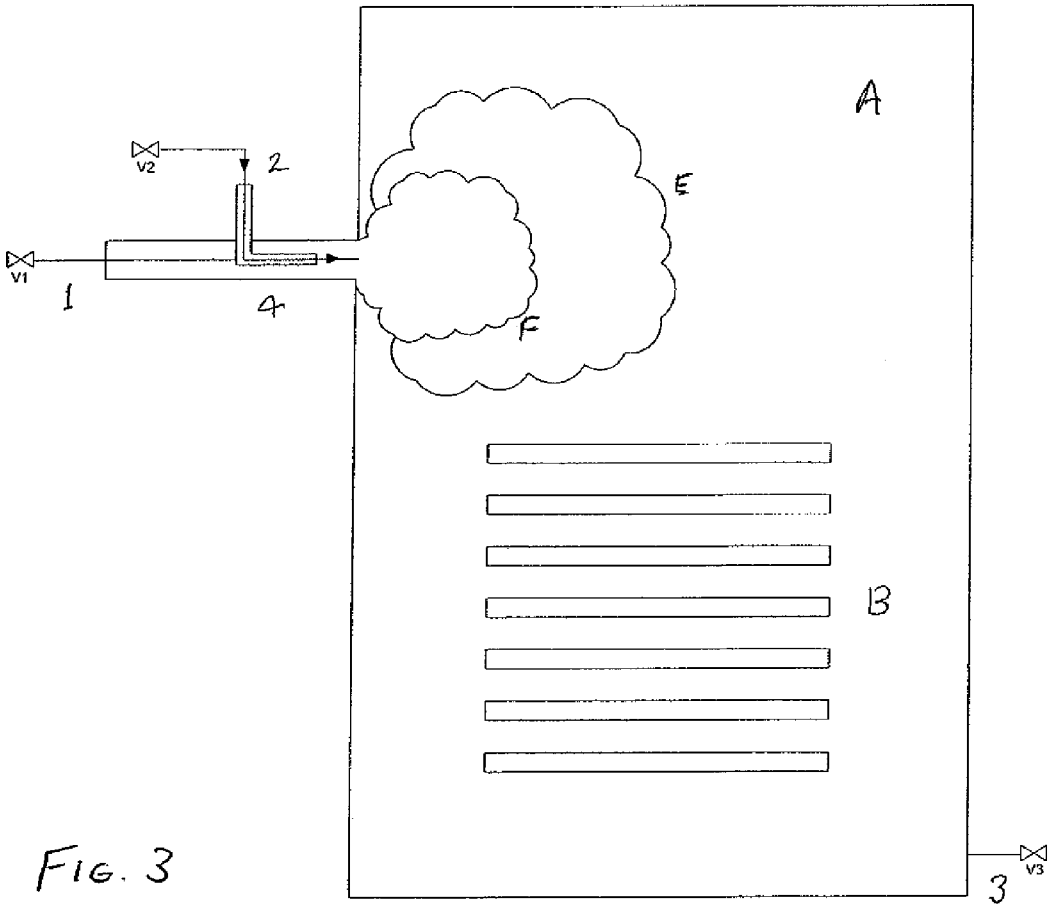
FIG. 3 is a schematic illustration of the third step of the method showing a water vapor region and mixed growth region in a freeze dryer.

FIG. 3 shows the next step in the method. Step 3 starts with valve V1 closed and valve V2 kept open such that only humid gas enters the chamber A through line 2 and tube 4 for a time t3. This results in the formation of a new water vapor region F. The ice fog region D from step 2 naturally mixes into the water vapor region G to form a mixed growth region E. The mixed growth region E is where the small ice nuclei are mixed with the unfrozen water vapor in the initial water vapor region and growth of the ice nuclei occurs as described above.

Figure 4:
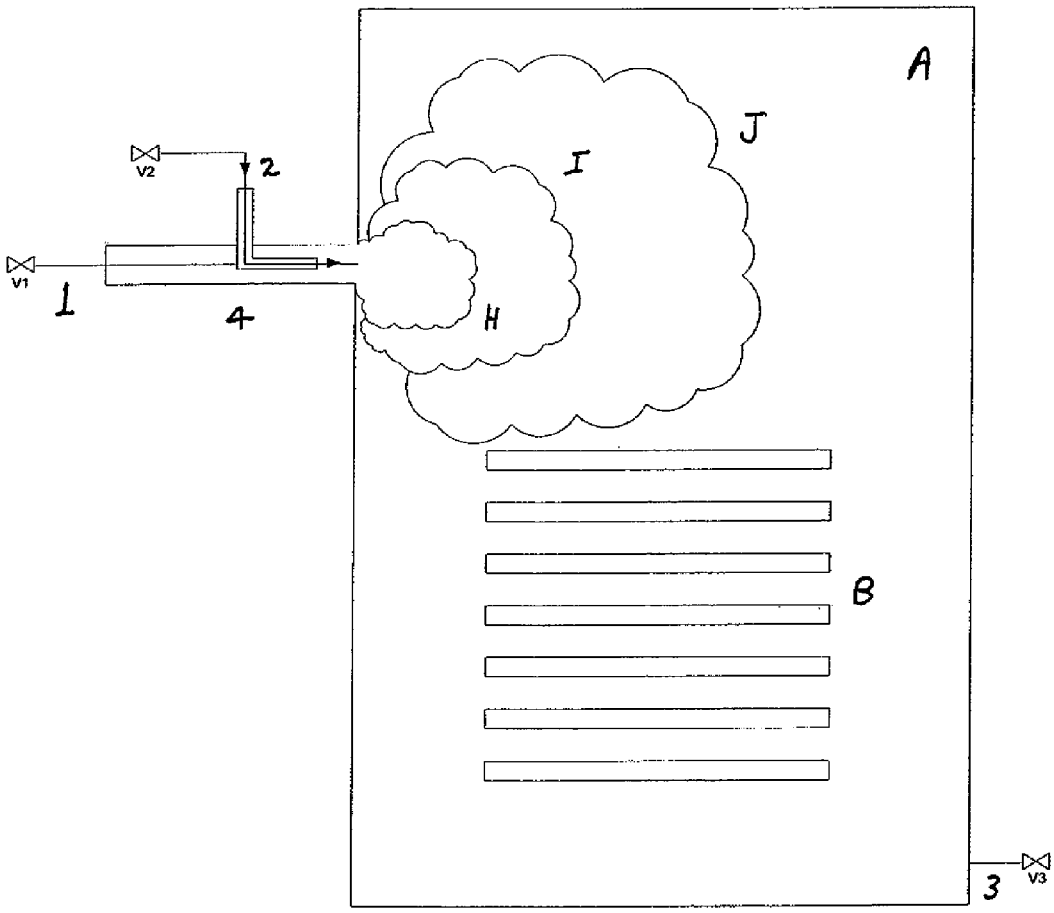
FIG. 4 is a schematic illustration of the next step of the method showing an ice fog region, a water vapor region and a mixed growth region entering a freeze dryer.

In step 4, which is depicted in FIG. 4, the valve V1 is opened while valve V2 remains open. The cryogenic fluid is fed through line 1 to tube 4 and comes in contact with the humid gas through line 2 where it freezes out the water vapor and generates a uniform dispersion of small ice nuclei. This is allowed to proceed for time t4 and at the end of t4, a second ice fog region H containing newly generated ice nuclei has been created. The water vapor region I and mixed growth region J have been expanded outwards into the freeze drying chamber A through the action of creating the ice fog region H.

Once the desired size and concentration of ice nuclei is achieved and distributed into the ice fog, the introduction of the nuclei into the vials may be facilitated by pressurizing the chamber A forcing the gas containing the ice crystals of the preferred size into each vial on the cold plates B. The pressurization would typically be produced by closing valve V3 and leaving either or both of valves V12 and V2 open. The physical parameters such as the temperature of the streams through V1 and V2 and the freezing chamber, humidity levels to produce the necessary degree of supersaturation, times t1, t2, t3 and t4 will depend upon the ice crystal properties deemed optimal for the particular component that is to be freeze dried. The sequence of creating mixed growth region followed by ice fog region may be repeated as many times as required to generate the desired density of preferably sized ice nuclei within the chamber.

The configuration for mixing the cryogenic cooling fluid and carrier gas may vary from that shown in FIGS. 1 to 4. Multiple injection points and alternative flow configurations may be employed to achieve various heat and mass transfer mixing techniques. Venturi or ejector injection techniques may be employed to improve ice fog formation, circulation and distribution.

While this invention has been described with respect to particular embodiments thereof, it is apparent that numerous other forms and modifications of the invention will be obvious to those skilled in the art. The appended claims in this invention generally should be construed to cover all such obvious forms and modifications which are within the true spirit and scope of the invention.

Having thus described the invention, what we claim is:

1. A method for forming a fog of ice nuclei in a freeze dryer comprising the steps: a) introducing a humid carrier gas into said freeze dryer, thereby forming a water vapor region; b) introducing a cryogenic fluid into said freeze dryer, thereby contacting said humid carrier gas and forming an ice fog region surrounded by said water vapor region; c) introducing a humid carrier gas into said freeze dryer, thereby forming a second water vapor region and said water vapor region and said ice fog region mix to form a mixed growth region; and d) introducing a cryogenic fluid into said freeze dryer, thereby contacting said second water vapor region to produce a second ice fog region within said second water vapor region and said mixed growth region.

2. The method as claimed in claim 1 wherein said freeze dryer comprises at least one means for inputting material and at least one means for venting material.

3. The method as claimed in claim 1 wherein a mixing zone is created at the entrance of said freeze dryer.

4. The method as claimed in claim 1 wherein said freeze dryer contains cold plates and vials on said cold plates.

5. The method as claimed in claim 1 wherein said ice fog region contains ice nuclei.

6. The method as claimed in claim 1 wherein said cryogenic fluid is selected from the group consisting of nitrogen, oxygen, air and argon.

7. The method as claimed in claim 1 wherein said humid gas stream comprises water vapor in nitrogen.

8. The method as claimed in claim 1 where said humid gas stream is selected from the group consisting of steam injection into nitrogen, sparging nitrogen into a water bath and spraying or atomizing water into a nitrogen stream.

9. The method as claimed in claim 1 wherein said ice nuclei grow in size in the mixed growth region.

10. The method as claimed in claim 1 wherein said second ice fog region contains newly generated ice nuclei.

11. The method as claimed in claim 1 wherein said newly generated ice nuclei are uniformly dispersed in said second ice fog region.

12. The method as claimed in claim 1 where said freeze chamber is pressurized to assist in introducing said ice nuclei into said vials.

13. The method as claimed in claim 1 wherein said cryogenic fluid is at a temperature of −20° C. to −180° C.

14. The method as claimed in claim 1 wherein said carrier gas is at a temperature of ambient to −70° C.

15. The method as claimed in claim 1 wherein steps c) and d) are repeated.

* * * * *